United States Patent [19]

Philips

[11] 4,100,866

[45] Jul. 18, 1978

[54] CORE CONSTRUCTION FOR A SEWING MACHINE BOBBIN

[75] Inventor: Michael R. Philips, Pomona, N.Y.

[73] Assignee: Jonathan Temple Incorporated, Hackensack, N.J.

[21] Appl. No.: 783,406

[22] Filed: Mar. 31, 1977

[51] Int. Cl.[2] ..... D05B 57/28

[52] U.S. Cl. ..... 112/231; 242/118.3

[58] Field of Search ..... 112/231, 188, 228, 229, 112/230, 3; 242/118.3, 118.31, 118.32, 129.5, 130, 132

[56] References Cited

U.S. PATENT DOCUMENTS

| | | | |
|---|---|---|---|
| 2,860,843 | 11/1958 | Van Katwijk | 242/118.3 |
| 3,450,370 | 6/1969 | Hawkins | 242/118.32 |
| 3,476,068 | 11/1969 | Preston | 112/231 |
| 3,563,197 | 2/1971 | Manze | 112/231 |
| 4,009,670 | 3/1977 | Mitchell | 112/231 |

*Primary Examiner*—Peter Nerbun

[57] ABSTRACT

A sewing machine bobbin adapted for disposal in a bobbin case. The bobbin includes a hollow cylindrical core on which a thread mass is wound adapted for slidable disposal over a center post mounted in the bobbin case, and a latch is mounted on the post for securing the cylindrical core and the thread mass in the bobbin case, the post and the latch having a combined axial length greater than the axial width of the bobbin case. The improvement of the invention comprises constructing the hollow cylindrical core so that the edge of at least one end thereof is axially tapered radially inwardly along the axis of the core away from its end towards the center post of the bobbin case and has an axial length which is greater than the axial distance between the bobbin case and the latch. The thread mass is wound on the core so that the tapered edge extends axially outwardly along the core axis beyond the surface of the thread mass. The tapered edge of the core cooperates with the latch to limit movement of the core on the post so that the surface of the thread mass does not extend axially outwardly beyond the bobbin case.

5 Claims, 11 Drawing Figures

Fig. 4.
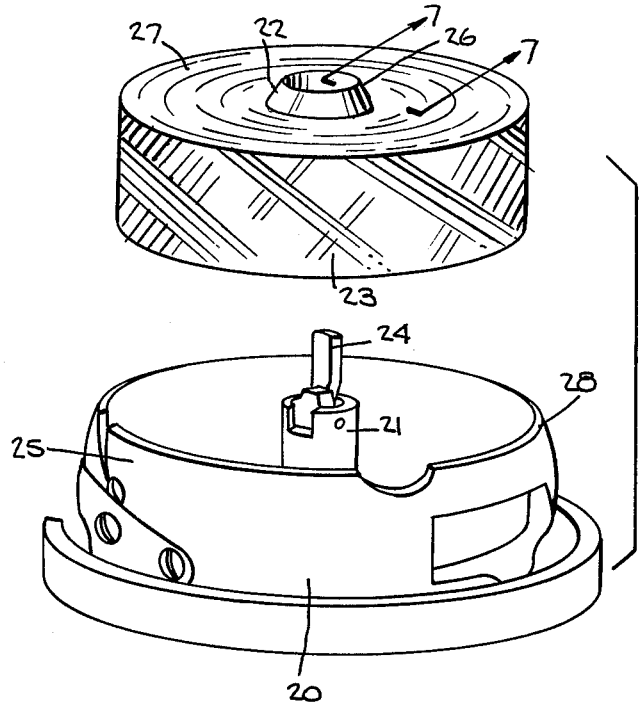
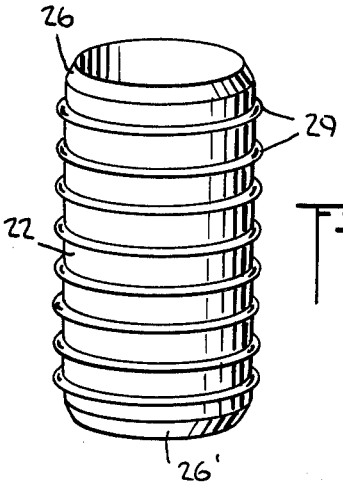
Fig. 6.
Fig. 7.
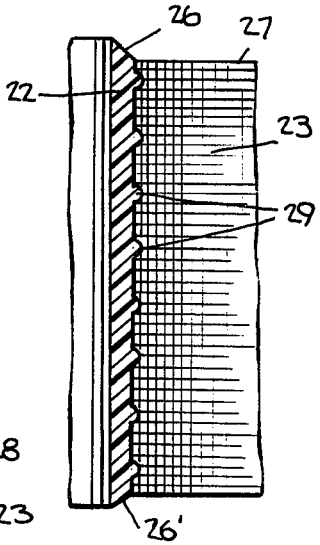
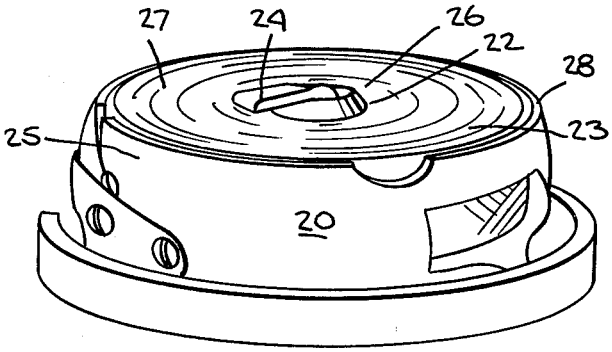
Fig. 5.

Fig. 8.
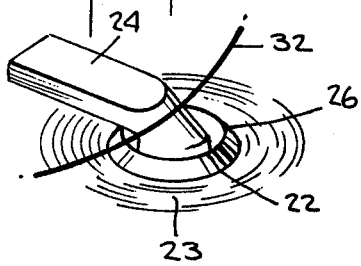
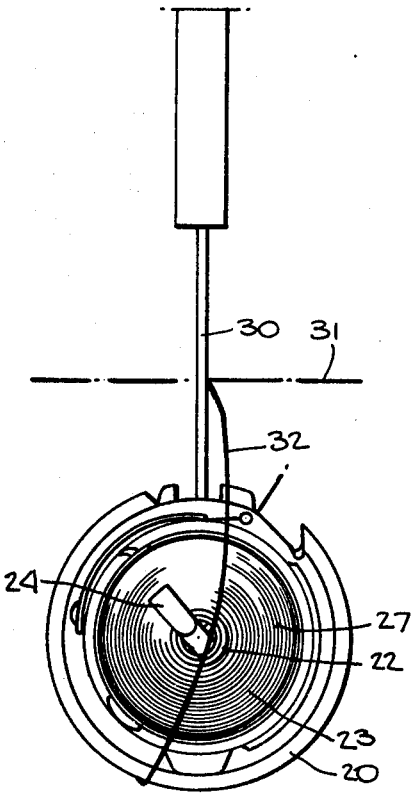
Fig. 9.
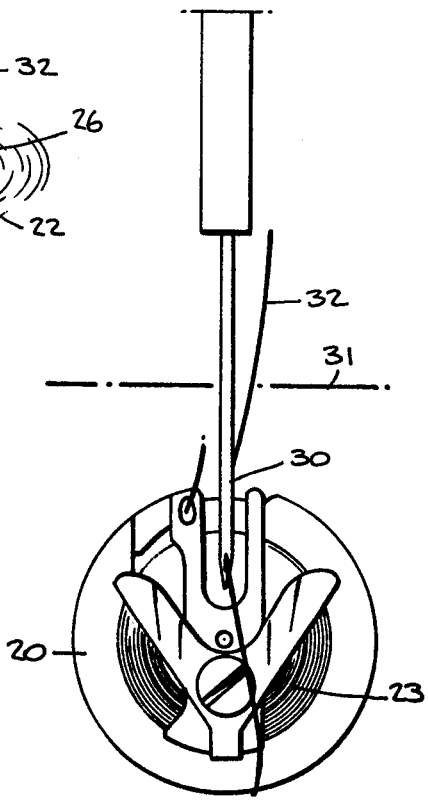
Fig. 10.
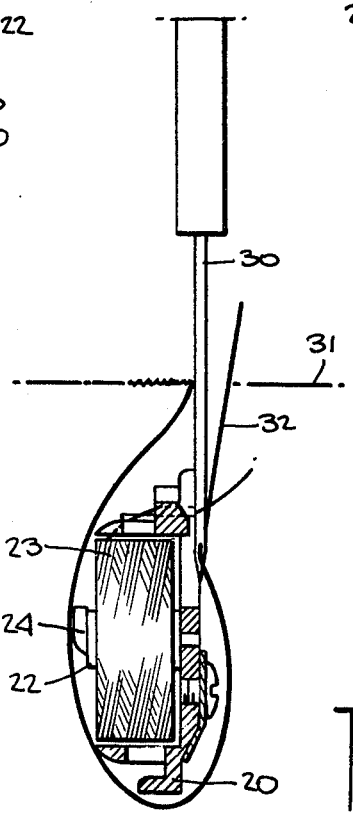
Fig. 11.

CORE CONSTRUCTION FOR A SEWING MACHINE BOBBIN

BACKGROUND OF THE INVENTION

1. Field of the Invention

The present invention relates generally to sewing machine bobbins, and in particular to an improved core construction for bobbins used in sewing machines utilized to manufacture mattresses and other quilting constructions.

2. Description of the Prior Art

Generally speaking, bobbins for use in sewing machines are known in the art. The function of a bobbin in a sewing machine is to interweave or "lock" the needle thread when the needle passes down through the fabric being sewn by the machine. The bobbin is rotated to pass the needle thread around the bobbin; the needle thread then retracts upwardly through the fabric. Typcial bobbins are disposed in a bobbin case which includes a center post mounted in the case and a pivotable latch mounted on the post, both of which have a combined axial length which is greater than the axial width of the bobbin case. Without a bobbin disposed in the bobbin case, a needle thread passed around the bobbin case would slide off the side thereof and engage the center post of the case. The result of this would be that the thread would catch on the center post and possibly break.

The conventional method of sewing with such sewing machines is to utilize a bobbin having a thread mass wound thereon to an axial thickness which is considerably less than the total height of the post in the center of the bobbin case. After the thread mass is wound on the bobbin to the required height, the operator of the sewing machine presses a pair of metal sides, which are generally circular in shape and have a cylindrical core extending outwardly from one side thereof, onto the bobbin within the inner space of the cylindrical core on which the thread mass is wound. The metal sides of the bobbin case facilitate a smooth transition of the needle thread during sewing from its starting point over the top of the bobbin case, the side of the bobbin, and the latch of the bobbin case. The disadvantage of utilizing such a bobbin is that after winding the thread mass on the core, additional sewing machine operator time is required to assemble and disassemble the bobbin during use. Also, the space taken up by the sides of the bobbin reduces the space available for the thread mass on the bobbin.

In order to enable more thread to be wound on the bobbin, and to avoid the need to assemble and disassemble bobbins with metal sides, it is possible to eliminate the metal sides completely from the bobbin and fill the entire space from the bottom of the bobbin case to the latch of the bobbin case with the thread mass. The disadvantage of this bobbin configuration, however, is that the needle thread interferes with the exposed shoulder of the bobbin thread in most cases and causes the thread to catch and possibly break during sewing.

The type of sewing machines described above are commonly used in the manufacture of mattresses and other quilting constructions. In one such machine, two or three sewing machine heads are utilized and the bobbins are held in the sewing machine in a vertically upward position. In certain models of such machines, as many as 36 bobbins may be required to be changed at one time. Thus, in utilizing such a machine, considerable time may be expended by an operator in assembling and disassembling bobbins with metal sides. In other typical sewing machines, two or three sewing machine heads are utilized but the bobbin case is placed within the machine so that the bobbin and the shuttle thereof are disposed in an upside-down position. Such positioning of the bobbin case increases the possibility that the needle thread and bobbin will interfere with one another during the sewing operation.

There is, thus, a need for a bobbin construction for sewing machines, particularly those used in the manufacture of mattresses and other quilting constructions, which is simple in design and may be efficiently assembled and, in addition, will eliminate interference between the sewing machine needle thread and the bobbin due to the positioning of the bobbin case in the sewing machine.

SUMMARY OF THE INVENTION

It is therefore an object of the present invention to provide an improved core construction for a sewing machine bobbin which overcomes the above-described disadvantages of heretofore known sewing machine bobbins and which enables such bobbins to be easily and efficiently assembled and eliminates interference between the needle thread of the sewing machine and the bobbin during the sewing operation.

These and other objects of the invention are achieved in a sewing machine bobbin adapted for disposal in a bobbin case which includes a hollow cylindrical core on which a thread mass is wound adapted for slidable disposal over a center post mounted in the bobbin case. The bobbin case includes latch means mounted on the post for securing the cylindrical core and the thread mass in the bobbin case, the post and the latch means having a combined axial length which is greater than the axial width of the bobbin case. The improvement of the invention comprises the hollow cylindrical core having the edge of at least one end thereof axially tapered radially inwardly along the axis of the core away from the core end towards the center post of the bobbin case. The thread mass is wound on the core so that the tapered edge thereof extends axially outwardly along the core axis beyond the surface of the thread mass. The tapered edge has an axial length which is greater than the axial distance between the bobbin case and the latch means, and the edge cooperates with the latch means to limit movement of the bobbin core on the center post so that the surface of the thread mass does not extend axially outwardly beyond the bobbin case, i.e., the edge of the bobbin case.

The foregoing arrangement according to the invention eliminates the need to use metal sides in the bobbin and the requirement for assembly and disassembly of the bobbin, i.e., mounting and demounting the metal sides, and, thus, reduces the amount of labor involved in readying the bobbin for use in the sewing machine. Also, elimination of the metal sides of the bobbin permits additional thread to be wound on the core of the bobbin and, accordingly, the bobbin constructed according to the invention will contain a greater length of thread compared to conventional bobbins utilizing metal sides. The tapered ends of the core facilitate a smooth transition of the needle thread of the machine across the top of the bobbin and off the latch on the bobbin case post.

In one embodiment of the invention, the edge of the other end of the cylindrical core of the bobbin is also axially tapered radially inwardly along the axis of the core away from the core end towards the center post of the bobbin case. The thread mass is wound on this core so that the tapered edges at both ends of the core extend axially outwardly along the core axis beyond the surfaces of the thread mass. Both of the tapered edges of the core have an axial length which is greater than the axial distance between the bobbin case and the latch means and one of the edges cooperates with the latch means to limit movement of the bobbin core on the center post so that the surface of the thread mass does not extend axially beyond the bobbin case. Such a configuration produces a symmetrical core for the bobbin and avoids operator error in installing the bobbin and assembly errors during manufacturing of the bobbin. Such a core preferably comprises an injection-molded, plastic hollow cylindrical core.

In another embodiment of the invention, the tapered edge of the core end is angled radially inwardly along the core axis from a point below the edge of the bobbin case so that planes at opposite points on the circumference of the core edge are disposed and intersect at an angle of approximately 90° with respect to each other. This configuration permits the needle thread, as previously explained, to slide up the angular incline at the edge of the core and over the latch of the bobbin case without interference. The core of the bobbin may also include a plurality of circumferential, axially spaced-apart ridges disposed on the outer surface thereof. These ridges serve to maintain a very accurate positioning of the thread mass on the core and insure that the thread mass and the core do not move relative to one another.

These and other novel features and advantages of the invention will be described in greater detail in the following detailed description.

BRIEF DESCRIPTION OF THE DRAWINGS

FIG. 4 is a perspective view of an improved sewing machine bobbin constructed according to the present invention showing the bobbin and bobbin case in their disassembled condition;

FIG. 5 is a perspective view of the bobbin of FIG. 4 showing the bobbin and bobbin case in their assembled condition;

FIG. 6 is a perspective view of the cylindrical core of an improved sewing machine bobbin constructed according to the present invention;

FIG. 7 is a partial, enlarged cross-sectional view of the thread mass and cylindrical core of a sewing machine bobbin constructed according to the present invention, taken along section 7—7 of FIG. 4;

FIG. 8 is an enlarged, perspective view of one end of the cylindrical core of an improved sewing machine bobbin constructed according to the invention shown in its position secured in the bobbin case by the latch of the bobbin case;

FIG. 9 is a side view of one end of the bobbin shown in the bobbin case during operation of the sewing machine;

FIG. 10 is a side view of the other end of the bobbin and bobbin case of FIG. 9; and FIG. 11 is a cross-sectional view of the bobbin and bobbin case of FIGS. 9 and 10.

DETAILED DESCRIPTION

Figure 1:
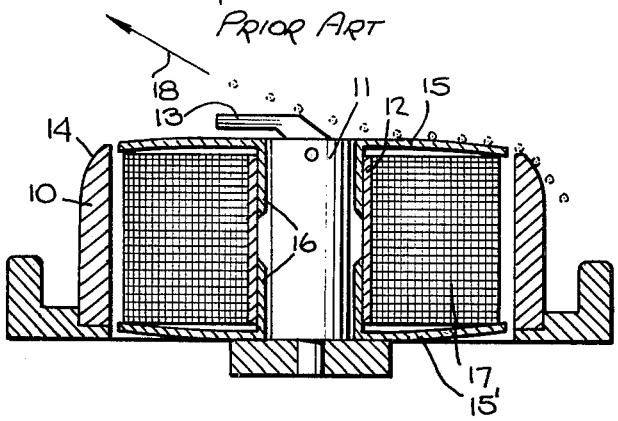
Fig. 1. PRIOR ART
FIG. 1 is a cross-sectional, side view of one type of prior art sewing machine bobbin showing the bobbin in a bobbin case.
Figure 2:
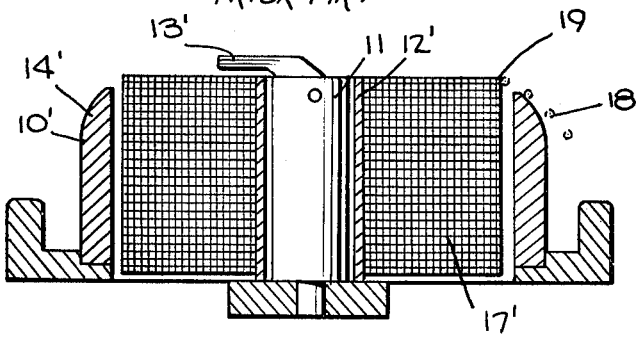
Fig. 2. PRIOR ART
FIG. 2 is a cross-sectional, side view of another type of prior art sewing machine bobbin showing the bobbin in a bobbin case.

Referring now to the drawings, in particular to FIGS. 1 and 2, there are shown two types of sewing machine bobbins which are known in the prior art. In FIG. 1, the bobbin is disposed in a bobbin case 10 having a center post 11 mounted in the bobbin case and includes a hollow cylindrical core 12 on which a thread mass 17 is wound which is slidably disposed over post 11. A latch 13 is pivotably mounted on post 11 for securing core 12 and thread mass 17 in the bobbin case, and, as can be seen from the drawings, center post 11 and latch 13 have a combined axial length which is greater than the axial width of the bobbin case, i.e., the width of wall 14 of the case, and extend beyond the edge of the side of the case on which latch 13 is disposed. Convex metallic sides 15 and 15', each of which include a cylindrical core 16 integrally joined therewith in perpendicular relationship thereto, are slidably disposed within the inner space of bobbin core 12. Thread mass 17 and core 12 are disposed between metal sides 15.

In assembly such a bobbin for use in a sewing machine, the bobbin is removed from bobbin case 10 by the machine operator and the metal sides withdrawn from core 12. The thread mass 17 is then wound on core 12 to an axial height equal to that of the core, which is significantly less than the axial height of center post 11. Metal sides 15 and 15' are then slidably inserted into core 12 and the bobbin is inserted into case 10 by sliding core 12 with the metal sides secured thereto over latch 13 (which is pivoted to a position extending vertically upwardly parallel to the longitudinal axis of post 11 for removal of the bobbin) and over post 11 into bobbin case 10. Latch 13 is then pivoted to its horizontal position illustrated in FIG. 1 to secure the bobbin in case 10.

During operation of the sewing machine, the needle thread is caused to slide from a starting point engagement with wall 14 of the bobbin case, movement of thread being shown by the dotted line and arrow 18 in FIG. 1, over the top edge of the wall 14 of the case, along metal side 15 and over latch 13. This configuration of the bobbin produces a smooth transition of the needle thread from its starting point at the top of the bobbin case over the metal side of the bobbin and the latch of the case. The principal disadvantage in using such a bobbin is, however, the time required for assembling and disassembling the bobbin and the limitations on the size of thread mass 17 due to the space taken up by the metal sides in the bobbin.

Another type of bobbin construction known in the art is illustrated in FIG. 2. In this bobbin, the metal sides are eliminated and the bobbin is disposed in bobbin case 10' over center post 11' mounted in the case and is secured in the case by latch 13' pivotably mounted on the center post. The bobbin includes a hollow, cylindrical core 12' on which thread mass 17' is wound which is slidably disposed over the center post of the bobbin case. In this type of bobbin, core 12' has an axial length equal to that of center post 11' and extends from the bottom of bobbin case 10' to latch 13' of the case. Thread mass 17' is wound on core 12′ along its entire axial length, and, as illustrated in the drawings, protrudes axially beyond the edge of wall 14′ of the bobbin case.

Such a configuration offers the advantage that the time required for assembly and disassembly of the metal sides of the bobbin is eliminated and a greater length of thread can be wound on the bobbin core. The disadvantage which results, however, is that interference is produced between the needle thread and the exposed shoulder 19 of the thread mass as the needle thread slides over the edge of the wall of the bobbin case. This interference is illustrated by the dashed line 18′ in FIG. 2. Such interference causes the thread to catch on the bobbin and may cause breakage of the thread.

Figure 3:
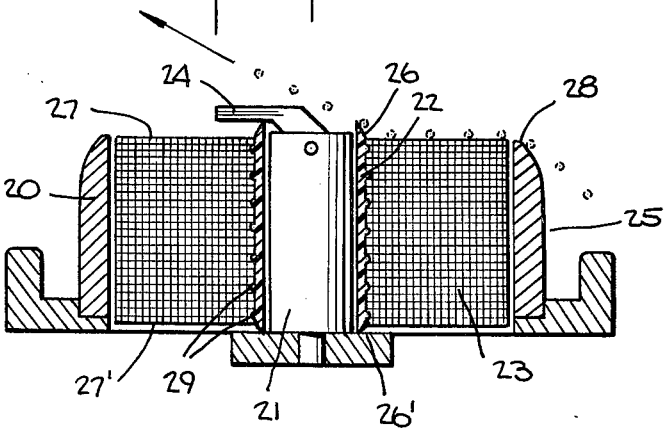
FIG. 3 is a cross-sectional, side view of an improved sewing machine bobbin constructed according to the present invention showing the bobbin in a bobbin case.

The improved bobbin construction of the invention is illustrated in FIGS. 3 through 7 of the drawings. This sewing machine bobbin is disposed in a bobbin case 20 having a center post 21 mounted in the bobbin case and includes a hollow cylindrical core 22 on which a thread mass 23 is wound which is slidably disposed over post 21. A latch 24 is pivotably mounted on post 21 for securing the core and the thread mass in the bobbin case. As shown in FIG. 3, post 21 and latch 24 have a combined axial length which is greater than the axial width of wall 25 of bobbin case 20. Hollow cylindrical core 22 has the edges 26 and 26′ thereof axially tapered radially inwardly along the longitudinal axis of the core away from the core end towards center post 21, and thread mass 23 is wound on core 22 so that edges 26 and 26′ extend axially outwardly at each end of the core beyond the surfaces 27 and 27′ of thread mass 23. Both of the tapered edges 26 and 26′ have an axial length which is greater than the axial distance between the bobbin case, i.e., the edge 28 of bobbin case 20, and latch 24 in its locking, i.e., horizontal, position. In the illustrated embodiment of the invention, one of the edges, edge 26, cooperates with latch 24 to limit movement of core 22 on post 21 so that the surface 27 of the thread mass does not extend axially outwardly beyond edge 28 of bobbin case 20. In other words, the axial length of edge 26 is such that in the normal operating position of the bobbin, the edge does not touch latch 24 (a maximum tolerance of 0.005 inch would be typical) so that frictional drag on the bobbin is not generated. If, however, the bobbin core slides toward the latch during operation, the edge engages the latch (shown in FIG. 3) and prevents the surface 27 of the thread mass on the core from moving outwardly beyond the edge of the bobbin case. Edges 26 and 26′ of core 22 are each axially tapered and are angled radially inwardly from a point below edges 28 of bobbin case 20 so that the planes at opposite points on the circumference of each edge are disposed and intersect at an angle of approximately 90° with respect to each other. As shown in detail in FIGS. 6 and 7, core 22 may include a plurality of circumferential, axially spaced-apart ridges 29 disposed on the outer surface of core 22 for accurately maintaining the position of the thread mass on core 22 and preventing relative movement of the thread mass with respect to core 22. The core of the bobbin is preferably fabricated of plastic material by an injection-molding process.

In assembling the bobbin according to the invention, thread mass 23 is wound on core 22 so that tapered edges 26 and 26′ extend axially outwardly beyond the surfaces of the thread mass 23. The assembled bobbin is then inserted into case 20 by sliding core 22 over center post 21 and latch 24. When the bobbin is fully inserted in case 20, latch 24 is pivoted to its horizontal position shown in FIG. 5 to secure the bobbin and the thread mass in the case. In this position, the latch will cooperate with edge 26 of core 22 in the manner previously described and hold the bobbin in case 20 so that surface 27 of the thread mass does not extend axially outwardly beyond edge 28 of bobbin case 20.

FIGS. 8 through 11 illustrate the operation of the bobbin during sewing. As the sewing machine needle 30 passes down through the fabric 31 being sewn, the bobbin, which floats with the bobbin case in which it is disposed within the sewing machine without firm physical attachment, carries the needle thread 32 around the entire bobbin case. As the needle thread moves approximately three-quarters of the way around the outside of the bobbin case, thread 32 slips off the bottom of the case, slides over the surface 27 of thread mass 23, and engages the tapered edge 26 at the end of core 22. The edge permits the thread to slip over the core and over latch 24 on center post 21 as the rotation of the bobbin is completed and the needle thread 32 is retracted upwardly. The transitional movement of the needle thread 32 over core 22 and latch 24 is illustrated in detail in FIG. 8. The same operation is repeated for each rotation of the bobbin initiated by a downward stroke of sewing needle 30.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a sewing machine bobbin adapted for disposal in a bobbin case, said bobbin including a hollow cylindrical core on which a thread mass is wound adapted for slidable disposal over a center post mounted in said bobbin case, said bobbin case including latch means mounted on said post for securing said cylindrical core and said thread mass in said bobbin case, and said post and said latch means having a combined axial length greater than the axial width of said bobbin case, the improvement comprising said hollow cylindrical core having the edge of at least one end thereof axially tapered radially inwardly along the axis of said core away from said end towards said center post, said thread mass being wound on said core so that said tapered edge extends axially outwardly along said core axis beyond the surface of said thread mass, said edge having an axial length which is greater than the axial distance between said bobbin case and said latch means, said edge cooperating with said latch means to limit movement of said core on said post so that said surface of said thread mass does not extend axially beyond said bobbin case.

2. The bobbin recited in claim 1, wherein the edge of the other end of said cylindrical core is axially tapered radially inwardly along the axis of the core away from said other end towards said center post of said bobbin case, said thread mass being wound on said core so that said tapered edges at both ends of said core extend axially outwardly along said core axis beyond the surface of said thread mass, both of said tapered edges having an axial length which is greater than the axial distance between said bobbin case and said latch means, one of said edges cooperating with said latch means to limit movement of said core on said post so that said surface of said thread mass does not extend axially beyond said bobbin case.

3. The bobbin recited in claim 1, wherein said tapered edge of said core is angled radially inwardly along said core axis from a point below an edge of said bobbin case so that planes at opposite points on the circumference of said core edge are disposed and intersect at an angle of approximately 90° with respect to each other.

4. The bobbin recited in claim 1, wherein said core further comprises a plurality of circumferential axially spacedapart ridges disposed on the outer surface of said core.

5. The bobbin recited in claim 1, wherein said hollow cylindrical core comprises an injection-molded, plastic hollow cylindrical core.

* * * * *

UNITED STATES PATENT AND TRADEMARK OFFICE

CERTIFICATE OF CORRECTION

PATENT NO. : 4,100,866

DATED : July 18, 1978

INVENTOR(S) : Michael R. Philips

It is certified that error appears in the above-identified patent and that said Letters Patent are hereby corrected as shown below:

Col. 4, line 30 "assembly" should be --assembling--.

Col. 8, line 5 "spacedapart" should be --spaced-apart--.

Signed and Sealed this

*Second* Day of *January 1979*

[SEAL]

*Attest:*

RUTH C. MASON
*Attesting Officer*

DONALD W. BANNER
*Commissioner of Patents and Trademarks*